US005676463A

United States Patent [19]

Larsen

[11] Patent Number: 5,676,463

[45] Date of Patent: Oct. 14, 1997

[54] PLASTIC PAINT MIXING SYSTEM

[76] Inventor: Paul R. Larsen, 8149 Highway 57, Baileys Harbor, Wis. 54202

[21] Appl. No.: 682,196

[22] Filed: Jul. 17, 1996

[51] Int. Cl.[6] ..... B01F 7/32

[52] U.S. Cl. ..... 366/251; 366/331; 366/605

[58] Field of Search ..... 366/64–66, 242–251, 366/262, 263, 265, 270, 325.92, 325.93, 328.2–328.4, 331, 342, 343, 347, 605

[56] References Cited

U.S. PATENT DOCUMENTS

| | | | |
|---|---|---|---|
| 2,123,600 | 7/1938 | Galante | 366/247 X |
| 2,579,874 | 12/1951 | Shaw | 366/247 |
| 2,898,094 | 8/1959 | O'Neill, Jr. | 366/605 X |
| 3,704,007 | 11/1972 | Kroeger | 366/248 |
| 4,422,770 | 12/1983 | Geible | 366/248 |
| 5,094,543 | 3/1992 | Murzsa | 366/605 X |
| 5,199,788 | 4/1993 | Stallings | 366/605 X |
| 5,251,979 | 10/1993 | Larsen | 366/248 |

FOREIGN PATENT DOCUMENTS

| | | | |
|---|---|---|---|
| 2083901 | 5/1993 | Canada | 366/245 |

*Primary Examiner*—Charles E. Cooley

*Attorney, Agent, or Firm*—Andrus, Sceales, Starke & Sawall

[57] ABSTRACT

A paint mixing system includes a paint can lid having a mixing paddle that can be rotated by a power drill or the like. The paint mixing system is preferably constructed entirely of plastic (e.g. molded high density polyethylene), except for a self-lubricating washer. The paint mixing system includes a plastic lid having an integral bore, a coupler that is secured for rotation within the lid bore, and a mixing paddle attached to the coupler below the lid. The coupler has a cylindrical upper portion and a cylindrical lower portion that has a smaller diameter than the upper portion. Likewise, the integral bore has a cylindrical upper portion that is larger than a lower cylindrical portion. The coupler fits closely within the lid bore, but not snugly so that the coupler can rotate freely within the bore. The self-lubricating washer, preferably a synthetic petroleum based self-lubricating washer, is provided at an interface between the coupler and the bore to facilitate rotation of the coupler within the bore without creating excessive frictional heat that could otherwise compromise the integrity of the system when the coupler is rotated at fast speeds over a long period of time. A drive element for the coupler is detachable from the coupler. Preferably, the lid includes an integral drive element holder to store the drive element when it is not engaged in the coupler. The system also includes a mixing paddle configuration that facilitates effective mixing of paint at the bottom of the paint can together with the remainder of the paint in the can.

14 Claims, 2 Drawing Sheets

FIG. 1
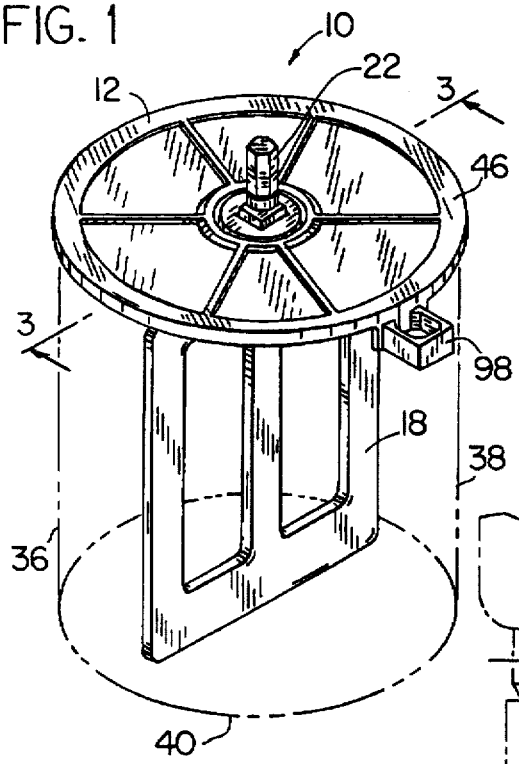
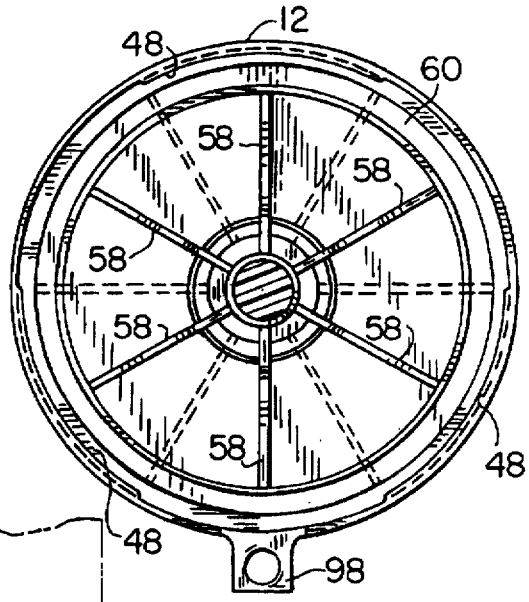
FIG. 5
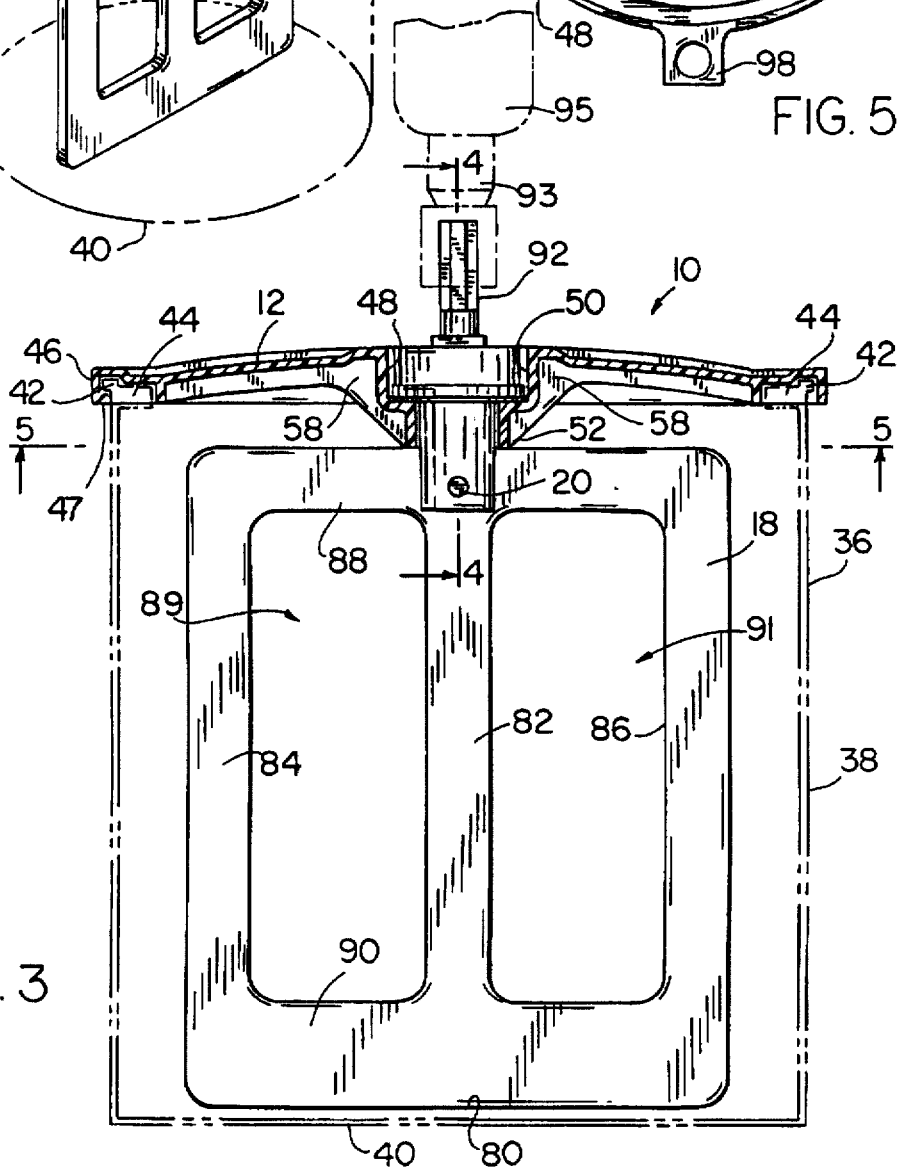
FIG. 3

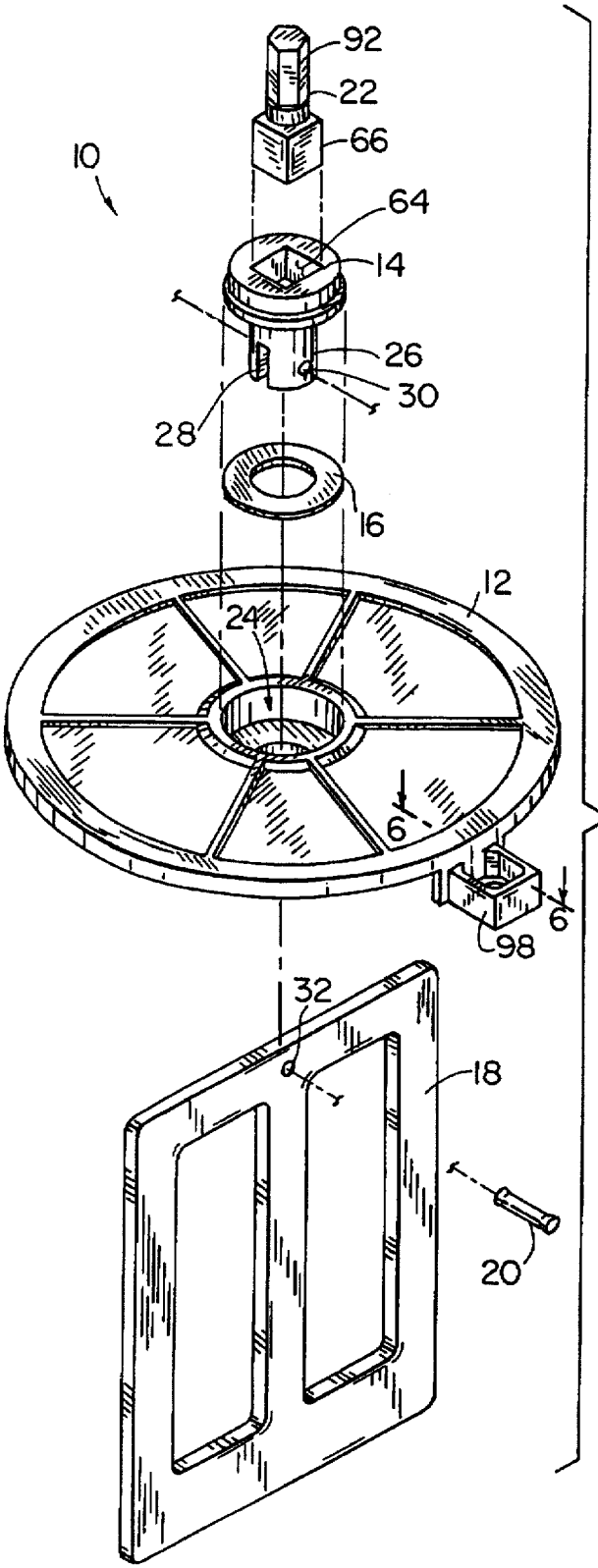
FIG. 2
FIG. 4
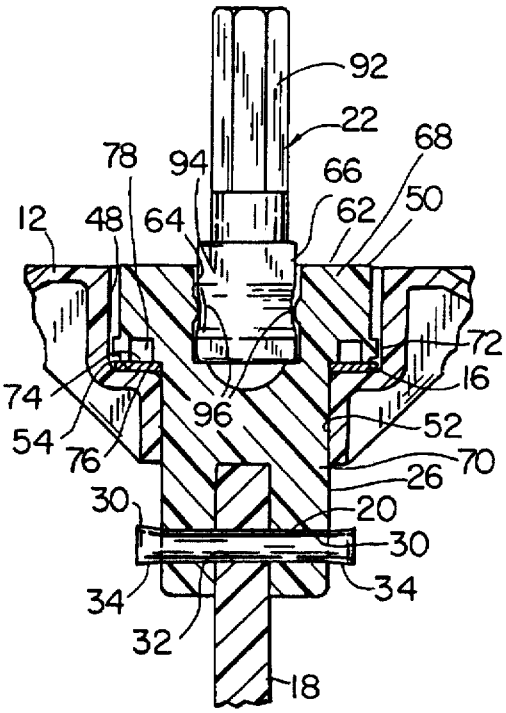
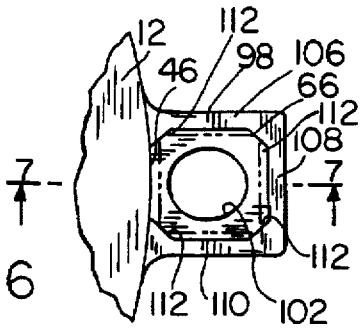
FIG. 6
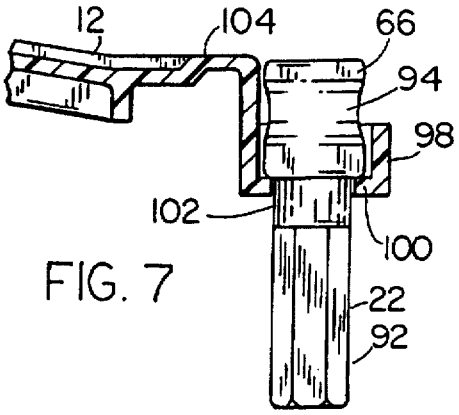
FIG. 7

PLASTIC PAINT MIXING SYSTEM

FIELD OF THE INVENTION

The invention relates to a paint mixing system including a paint can lid having a mixing paddle that can be rotated by a power drill or the like.

BACKGROUND OF THE INVENTION

When paint is stored, the paint becomes thicker towards the bottom of the can than at the top of the can. Sometimes paint can become very thick at the bottom of the can, thus making it extremely difficult to completely stir the paint into a homogenous blend.

Various efforts have been made to facilitate mixing paint in a paint can including manually manipulated paddles, power driven mixing devices or stirrers, and devices that violently shake the paint can while the paint can lid is in place. Shaker-type mixers are usually found at commercial paint stores where paint is stored and sold to customers, with the shaking and mixing occurring at the time when the customer purchases the paint. Frequently, however, paint is not used immediately after purchase, and often the purchased paint should be mixed again immediately prior to use. In addition, even after using the paint, it is not uncommon that a portion of the paint in the can remain unused after the work day, therefore requiring that the unused portion be stored until a later time. It is likely that the remaining portion of paint in the can must be stirred again before use at a later time.

One particularly effective paint mixing system is disclosed in U.S. Pat. No. 5,251,979, entitled "Paint Can Cover With Mixer" by Paul R. Larsen, issued Oct. 12, 1993, which is incorporated herein by reference. The paint mixing system disclosed in U.S. Pat. No. 5,251,979 includes a paint can lid having a rotatable mixing paddle rotatably supported from the paint can lid. A rotational member (or coupler) is rotatably supported in an adapter mounted through the lid. The mixing paddle attaches to the coupler and is disposed within the paint can. The top surface of the coupler has a socket that is exposed above the top surface of the lid so that a drive element or bit can engage the socket. A power drill or the like can drive the drive element or bit to rotate the mixing paddle and stir paint within the paint can.

The paint mixing system shown in U.S. Pat. No. 5,251,979 provides for quick, effortless and thorough mixing without splashing or spilling paint. The mixing system disclosed in U.S. Pat. No. 5,251,979 has many desirable features including the ability to remove the drive element or bit so that a paint can with the system in place can be stacked conveniently with other cans of paint. The system in U.S. Pat. No. 5,251,979 also has an efficient sealing mechanism that renders the system substantially air-tight, therefore promoting long-term storage with the system in place. In addition, the system can be packaged in a compact manner and can be assembled quickly (i.e. less than a minute).

One problem with the system disclosed in U.S. Pat. No. 5,251,979 is that the detachable drive element was likely to become misplaced, especially if the paint were stored for a long period of time with the system in place.

The present invention arose during attempts to reduce the cost of manufacturing a paint mixing system as disclosed in U.S. Pat. No. 5,251,979 without sacrificing the primary features and advantages of that system, as well as making some improvements to the system. The primary thrust of these continuing developmental efforts focused on simplifying the system, namely providing a plastic lid having an integral bore that supports the coupler or rotational member, therefore eliminating the need for a separate adapter component. For this application, it was desirous to mold the components of the system (for example, the paint lid with integral bore, the coupler, the mixing paddle, and a tapered pin to secure the mixing paddle to the coupler) of high density polyethylene. It was believed that high density polyethylene would provide sufficient strength for the paddle and coupler, as well as the structure for the integral lid bore. However, during development, difficulties were encountered in attempts to mold a depending bore having the dimensional integrity required for this application (the ability to support rotating coupler and provide sealing capabilities). Also, it was found that excessive frictional heat would generate between the coupler and the integral lid bore when a drill was used to drive the system for longer periods of time. The frictional heat in combination with rotation movement would deteriorate the interface between the supporting lid bore and the coupler, and the integrity of the system would likely be compromised significantly.

SUMMARY OF THE INVENTION

In one aspect, the invention provides the use of a self-lubricating washer, preferably a synthetic petroleum based self-lubricating washer (such as the washers sold under the trademark NYLATRON), to reduce frictional heating and enable the effective use of a plastic circular lid having an integral bore supporting a plastic coupler. In this aspect, a paint mixing system in accordance with the invention includes a plastic circular lid having a circumferential rim for attaching the lid to an open top of a paint can. The plastic circular lid has a bore extending vertically downward from the center portion of the lid. The bore includes an upper cylindrical portion and a lower cylindrical portion. The diameter of the lower cylindrical portion of the bore is less than the diameter for the upper cylindrical portion. A horizontal seat spans from a bottom of the upper cylindrical portion to a top of the lower cylindrical portion. The mixing system also includes a plastic coupler that is rotatably supported within the vertical lid bore. The coupler is supported vertically by the horizontal seat in the lid bore. The coupler has a top side containing a socket that is exposed on the top side of the lid. The coupler has a generally cylindrical upper portion having a diameter slightly less than the diameter of the upper cylindrical portion of the lid bore. The coupler also has a generally cylindrical lower portion extending coaxially downward from the upper portion. The diameter for the lower portion of the coupler is slightly less than the diameter of the lower portion of the lid bore. An annular shoulder is present at the bottom of the upper portion of the coupler, and it prevents the coupler from moving past the horizontal seat in the lid bore. The lowermost portion of the coupler extends downward past the lower portion of the lid bore and is configured to provide a location for a mixing paddle to attach to the coupler. A drive element or bit having a socket portion corresponding to the socket on the top side of the coupler and a rod designed to engage a tool that provides rotational torque (e.g., a power drill or wrench) is used to drive the coupler and rotate the mixing paddle to mix paint within the paint can.

In accordance with a primary purpose of the invention, the self-lubricating washer is placed between the shoulder on the coupler and the horizontal seat on the lid bore to facilitate rotation of the plastic coupler within the plastic lid bore without generating excessive heat that could possibly compromise the integrity of the system.

To further reduce the amount of heat accumulating at the interface between the annular shoulder on the coupler and the horizontal seat of the bore, it may be desirable to provide an annular air gap on the bottom of the upper portion of the coupler just inside of a circumferential portion of the annular shoulder.

To add strength to the structure of the lid bore and overcome the difficulties in the molding process that could compromise the dimensional integrity of the integral bore, it is desirable to provide a plurality of ribs extending radially from the bore outward along the bottom surface of the plastic lid. The portions of the ribs near the bore serve to buttress the depending bore and preserve its dimensional integrity.

In another aspect of the invention, the lid provides an integral drive element holder peripheral to and adjacent the circumferential rim of the lid. The integral holder on the lid makes it substantially less likely that a user of the system will misplace the detachable drive element when the system is not in use. The preferred holder includes a bottom wall having a hole through which the rod portion of the drive element is designed to be placed. The hole in the bottom wall has a diameter greater than the diameter of the rod on the drive element, but less than the diameter of the socket portion of the drive element. The drive element can be stowed in the holder with the rod portion of the drive element passing through the hole in the bottom wall of the holder. The vertical distance between the bottom wall of the drive element holder and the top surface of the lid is preferably greater than the vertical distance of the socket portion on the drive element, thereby ensuring that the socket portion of the drive element does not extend upward of the top surface of the lid. In this manner, the drive element will not interfere, at least substantially, when paint cans are stored with the paint mixing system in place. In the event that the socket portion of the drive element provides a square or rectangular socket element, it is further preferred that the drive element holder have three sidewalls extending upward from the bottom wall to form a rectangular cube having an open top. There should be at least one slanted corner surface extending across the intersection of the sidewalls within the cube. The slanted corner surface provides frictional engagement force against the socket portion of the drive element to secure the drive element in the holder so that the drive element will not be loose and will not fall out unintentionally.

In another aspect, the invention provides a mixing paddle configuration that can improve mixing capabilities especially when paint towards the bottom of the can is excessively thick. In this respect, the mixing paddle can be described as a flat, generally open rectangular paddle having a vertical central member, two vertical side members, an upper horizontal member spanning across the top of the vertical central member between the top of the two vertical side members, and a lower horizontal member spanning across the bottom of the vertical central member between the bottom of the two vertical side members. The mixing paddle has at least two openings to promote passage of the paddle through the paint. In accordance with the invention, the vertical height of the lower horizontal member is substantially larger than the vertical height of the upper horizontal member. The added vertical height to the lower horizontal member on the mixing paddle has been found to provide more efficient mixing, especially when there is extremely thick paint towards the bottom of a paint can, and therefore reduces the amount of frictional heat generated at the coupler/bore interface.

Other features and advantages of the invention may be apparent to those skilled in the art upon inspecting the following drawings and description thereof.

BRIEF DESCRIPTION OF THE DRAWINGS

FIG. 1 is a perspective view of a paint mixing system in accordance with the invention showing a paint can in phantom.

FIG. 2 is an exploded assembly view of a preferred embodiment of a paint mixing system in accordance with the invention.

FIG. 3 is a view taken along lines 3—3 in FIG. 1.

FIG. 4 is a detail view of the invention taken along lines 4—4 in FIG. 3.

FIG. 5 is a view taken along lines 5—5 in FIG. 3.

FIG. 6 is a top view of a drive element holder as in accordance with one aspect of the invention.

FIG. 7 is a view taken along lines 7—7 in FIG. 6.

DETAILED DESCRIPTION OF THE DRAWINGS

Referring to the drawings, a paint mixing system 10 in accordance with the invention includes a circular lid 12, a coupler 14, a self-lubricating washer 16, a mixing paddle 18, a pin 20, and a drive element 22. The components of the paint mixing system 10, except for the self-lubricating washer 16, are preferably manufactured by injection molding plastic, preferably high density polyethylene. Thus, the paint mixing system 10 can be produced inexpensively.

FIG. 2 illustrates the components of the paint mixing system 10 disassembled. When the components of the paint mixing system 10 are disassembled, the components 12, 14, 16, 18, 20, and 22 fit compactly into packaging that is suitable for effective distribution. The components of the paint mixing system 10 can be easily assembled at the point of use in a short period of time (e.g., less than a minute). To assemble the paint mixing system 10, the coupler 14 is placed through the self-lubricating washer 16 and also through an internal bore 24 in the lid 12. With the coupler 14 in place through the lid bore 24, a lowermost portion, i.e. a paddle attachment portion 26, of the coupler 14 is exposed underneath the lid 12. The mixing paddle 18 is attached to the paddle attachment portion 26 of the coupler 14. The paddle attachment portion 26 of the coupler 14 has a diametric slit 28 into which a top center portion of the mixing paddle 18 fits. The paddle attachment portion 26 of the coupler 14 also has holes 30 which are transverse to the diametric slit 28. The mixing paddle 18 is secured within the diametric slit 28 by inserting pin 20 through holes 30 in the paddle attachment portion 26 of the coupler 14 and through a hole 32 in the central upper portion of the mixing paddle 18. As shown best in FIG. 4, the pin 20 is preferably pressed into holes 30 in the coupler 14 and hole 32 in the mixing paddle 18. In this configuration, the pin 20 preferably includes tapered ends 34 to ensure that the pin 20 does not dislodge. Alternatively, a threaded pin may be used, and screwed into place to secure the mixing paddle 18 to the lower paddle attachment portion 26 of the coupler 14. In any event, it should be appreciated that the paint mixing system 10 can be easily and quickly assembled once the system 10 is removed from its package at the point of use.

Referring in particular to FIGS. 1 and 3, the circular lid 12 attaches to an open top of a paint can 36 to use the paint mixing system 10. The lid 12 is sized to fit a conventional paint can 36. A conventional paint can 36 has a cylindrical peripheral wall 38 and a circular bottom 40. Conventional paint cans 36 are constructed from sheet metal or the like and come in standard sizes. The upper end of the peripheral wall 38 normally includes a rim 42 and a channel 44. A conventional paint can also has a cover that is removed to use the paint in the can. To use the paint mixing system 10, the paint can cover is removed and the system 10 is put in its place.

Referring now in particular to FIGS. 3–5, the plastic circular lid 12 has a circumferential rim 46 for attaching the lid 12 to the top end of the paint can 36. To fit on conventional paint cans, the diameter of the circular lid 12 should be about 6.3 inches, including the circumferential rim 46. The rim 46 includes an inward flare 47 to facilitate a secure fit of the plastic lid 12 over the upper rim 42 on the paint can 36. Note that it is not critical, or even desirable, for the inward flare 47 on the lid 12 rim to be continuous around the circumferential rim 46 of the lid 12 (See, for instance, FIG. 5 and upper right-hand side of FIG. 3). As drawn in FIG. 3, the lid 12 has a slight upward bulge so that the middle portion of the lid 12 is slightly higher than the top surface of the lid around the circumferential rim 46. FIG. 3 exaggerates the bulge in the lid 12, to emphasize that a slight bulge is desirable for strength and molding purposes. While it is desirable to have a slight bulge, the center portion of the lid 12 should not be raised too much above the circumferential rim 46 of the lid, otherwise stacking of the paint can 36 with the mixing system 10 in place and the drive element 22 stowed will be awkward.

The plastic lid 12 includes an integral bore 48 through a center of the lid 12. The purpose of the bore 48 is to rotatably support the coupler 14. The bore 48 extends vertically downward from the lid 12. The integral lid bore 48 includes an upper cylindrical portion 50, and a lower cylindrical portion 52. The preferred diameter of the upper cylindrical portion 50 is about 1.25–1.50 inches. The diameter of the lower cylindrical portion of the bore 48 is less than the diameter for the upper cylindrical portion 50, and is preferably about 0.50 to 1.00 inches. A horizontal seat 54 spans from a bottom of the upper cylindrical portion 50 and a top of the lower cylindrical portion 52.

It is important that the dimensional integrity of the integral bore 48 be maintained, during the manufacturing process, and also during use. In order to provide strength and rigidity, as well as promote proper curing of the integral plastic bore 48, a plurality of ribs 58 are provided on the bottom surface of the lid 12. There are preferably six equally spaced ribs 58 extending downward from the bottom surface of the lid 12 (FIG. 5). The ribs 58 extend radially from the bore 48 outward along the bottom surface of the lid 12. The ribs 58 terminate at a downward circular projection 60 on the lid, which lies inside of the position on the lid corresponding to the upper rim 40 on a conventional paint can 36. As shown best in FIG. 3, the ribs 58 form a buttress-like structure around the structure of the internal bore 48 in the plastic lid 12.

The plastic coupler 14 is rotatably supported within the vertical lid bore 48. The coupler 14 has a top side 62 that contains a socket 64. The socket 64 is preferably a generally square socket, that can receive a generally square socket portion 66 on the drive element 22. The coupler 14 has a generally cylindrical upper portion 68 and a generally cylindrical lower portion 70. The diameter of the generally cylindrical upper portion 68 of the coupler 14 is slightly less than the diameter of the upper cylindrical portion 50 of the lid bore 48. The outer surface of the upper cylindrical portion 68 includes a circumferential boss 72 that serves to reduce the amount of contacting surface area between the outer cylindrical surface of the coupler upper portion 68 and the upper portion 50 of the lid bore 48.

The diameter of the lower portion 52 of the coupler 14 is less than the diameter of the upper portion 68, and only slightly less than the diameter of the lower portion 52 of the supporting lid bore 48. As noted above, the lower portion 70 of the coupler 14 includes a paddle attachment section 26 that extends downward vertically past the bottom of the bore 48. It is important that the coupler 14 fit closely within the bore 48, however, the coupler 14 should not be snug and should be allowed to rotate freely within the bore 48.

The coupler 14 has an annular shoulder 74 at the bottom of the upper portion 68 of the coupler 14. The annular shoulder 74 includes a peripheral circumferential portion (also designated by reference numeral 74) and an inner circumferential portion 76. An air gap 78 is provided in the upper portion 68 of the coupler 14 between the peripheral circumferential portion 74 of the annular shoulder and the inside circumferential portion 76 of the annular shoulder. The air gap facilitates the dispersion of heat generated in the region between the annular shoulder 74 of the coupler 14 and the horizontal seat 54 in the vertical bore 12 when the coupler 14 rotates, especially at high speeds.

In accordance with one of the primary objects of the invention, the self-lubricating washer 16 is placed between the annular shoulder 74 on the coupler 14 and the horizontal seat 54 on the lid bore 48. As noted above, the self-lubricating washer is preferably a synthetic, petroleum-based washer such as the type of washer sold under the trademark NYLATRON. Use of the self-lubricating washer 16 facilitates rotation of the plastic coupler 14 within the lid bore 48 without generating excessive frictional heat at the interface between the annular shoulder 74 of the coupler 14 and the horizontal seat 54 in the lid bore 48. In this manner, the self-lubricating washer 16 significantly improves the durability of the interface between the coupler 14 and the lid bore 48. In addition, the washer 16 also helps to provide a seal between the coupler 14 and the lid bore 48. More particularly, when a can of paint 36 is stored with the mixing system 10 in place, it has been found that a film of paint will form at the interface between the coupler 14 and the lid bore 48 to provide a reasonably good seal and allow paint to be stored with the mixing system 10 in place for days or weeks without running the risk of drying the paint within the can. Providing the washer 16 between the annular shoulder 74 of the coupler 14 and the horizontal seat 54 of the vertical bore 48 enhances the ability of a film of paint to form at the interface, and thus provide adequate sealing.

Referring now to FIGS. 1 and 3, the mixing paddle 18 extends downward into the interior of the paint can 36. The mixing paddle 18 is a flat, and generally open rectangular paddle. The paddle should be thick enough to withstand mixing stresses (for instance, slightly less than 0.20 inches in the preferred structure). It is preferred that the shape of the mixing paddle 18 correspond generally to the inner shape of the paint can 36. In order to promote thorough mixing, especially of thickened paint towards the bottom of the paint can, it is preferred that the paddle 18 be designed so that a bottom edge 80 of the mixing paddle 18 be very close to the circular bottom 40 of the paint can (e.g. about ⅛ to ¼ of an inch from the bottom of a conventional paint can). The mixing paddle 18 includes a vertical central member 82 and two vertical side members 84 and 86. The mixing paddle 18 also includes an upper horizontal member 88 that spans across the top of the vertical central member 82 between the top of the two vertical side members 84 and 86. The mixing paddle 18 also has a lower horizontal member 90 that spans across the bottom of the vertical central member 82 between the bottom of the two vertical side members 84 and 86. As shown in the drawings, the preferred mixing paddle provides two large openings 89 and 91 through the paddle that allow the mixing paddle 18 to move through and mix the paint without causing extremely high stresses on the paddle 18. In order to promote complete homogenous mixing of paint located in the lower portion of the paint can 36 which may be thickened, the vertical height of the lower horizontal member 90 is substantially larger than the vertical height of the upper horizontal member 88. The preferred vertical height for the lower horizontal member 90 is about 1 inch, whereas the preferred vertical height of the upper horizontal member 88 is about ½ inch.

Referring now to FIGS. 1–4, the drive element 22 includes a rod 92 adapted to fit into the chuck 93 of a power drill 95, and as previously noted, a socket portion 66 adapted to fit into the socket 64 in the top side of coupler 14. The rod 92 preferably has a hexagonal cross-section. With the hexagonal cross-section, a rod 92 made of high density polyethylene has sufficient strength and durability for this application. The drive element 22 is designed to be removably or detachably inserted into the socket 64 in the coupler 14. To use the mixing system 10, the socket portion 66 of the drive element 22 engages the socket on the top side of the coupler 14, and is rotated by engaging the rod 92 of the drive element 22 with a drill to provide rotational torque, thus rotating the mixing paddle 18 to mix paint in the can 36. It should be noted that tools other than electrically powered drills can be used to drive the mixing system 10. For instance, it may be desirable to use some other type of power tool that can provide rotational torque, or even a manual wrench. As shown best in FIG. 4, the socket portion 66 of the drive element 22 has four concave sidewalls 94 forming a generally square socket configuration. On the other hand, the socket 64 in the top surface of the coupler 14 includes slight bosses 96 along the sidewalls of the socket 64. The concave construction of the walls on the socket portion 66 of the drive element 22 coupled with the slight inwardly extending bosses on the sidewalls of the socket 64 help to secure the drive element 22 in the coupler socket 64 when the system 10 is being used to mix paint.

It is desirable that the drive element 22 be removable from the coupler socket 64 so that the drive element 22 can be easily attached to a chuck 93 for a drill 95, and also to facilitate convenient storage of the paint can 36 with the mixing system 10 in place. In order to reduce the possibility of misplacing the drive element 22 when it is removed from the coupler socket 64, the lid provides an integral drive element holder 98, FIG. 1. The drive element holder 98 is peripheral to and adjacent the circumferential rim 46 of the lid 12. Referring to FIGS. 6 and 7, the drive element holder 98 includes a bottom cradle wall 100 having a hole 102 therethrough. The hole 102 in the bottom wall 100 of the holder 98 has a diameter larger than the rod portion 92 of the drive element 22, but smaller than the diameter of the socket portion 66 of the drive element 22. Therefore, the drive element 22 can be stowed in the holder 98 by placing the rod 92 through the hole 102 in the bottom cradle wall 100. It is preferred that the distance between the bottom wall 100 of the holder 98 and the top surface 104 of the lid 12 be greater than or equal to the vertical length of the socket portion 66 of the drive element 22 so that the drive element 22 does not interfere when storing the can of paint 36 with the system 10 in place. The drive element holder 98 has three sidewalls 106, 108, and 110 extending upward from the bottom wall 100 to form a rectangular cube having an open top in conjunction with the circumferential rim 46. Sidewalls 106 and 110 extend generally perpendicularly from the circumferential rim 46 to a parallel sidewall 108 spanning between the ends of sidewalls 106 and 110. The inside surface of the sidewalls 106, 108, 110 and the circumferential rim 46 forming the cube is preferably slightly larger than the size of the socket portion 66 of the drive element 22. Slanted corner surfaces 112 extend across the intersections of the sidewalls 106, 108, 110, and the circumferential rim 46 at each of the four vertical corners of the cube. The purpose of the slanted corner surfaces 112 is to provide frictional engagement force against the socket portion 66 of the drive element 22 to secure the drive element 22 in the holder 98 so that the drive element 22 does not dislodge from the holder 98 unintentionally.

The foregoing is an illustrative example of the invention. Modifications and equivalents may be apparent to those skilled in the art, and such modifications and equivalents should be considered to fall within the scope of the following claims.

I claim:

1. A paint mixing system comprising:

a plastic circular lid forming a cover for a paint can, the lid having a circumferential rim for attaching the lid to an open top of the paint can and a bore through a center portion of the lid, the bore extending vertically downward from the lid and including an upper cylindrical portion, a lower cylindrical portion that has a diameter less than a diameter for the upper cylindrical portion, and a horizontal seat spanning from a bottom of the upper cylindrical portion to a top of the lower cylindrical portion;

a plastic coupler located within the vertical lid bore, the coupler having a top side containing a socket, a generally cylindrical upper portion having a diameter slightly less than the diameter of the upper cylindrical portion of the lid bore, an annular shoulder at a bottom of the upper portion of the coupler, a generally cylindrical lower portion extending from the upper portion, the lower portion of the coupler having a diameter slightly less than the diameter of the lower portion of the lid bore and having a paddle attachment section that extends downward past the lower portion of the lid bore;

a self-lubricating washer placed between the shoulder on the coupler and the horizontal seat of the lid bore to facilitate rotation of the plastic coupler within the bore through the plastic lid;

a mixing paddle attached to the paddle attachment section of the lower portion of the coupler; and a drive element having a socket portion corresponding to the socket on the top side of the coupler and a rod, wherein the drive element can be used to drive the coupler by engaging the socket portion of the drive element with the socket on the top of the coupler and rotating the drive element by engaging the rod with a tool that can provide rotational torque.

2. The invention as recited in claim 1 wherein the self-lubricating washer is a synthetic petroleum based self-lubricating washer.

3. The invention as recited in claim 1 wherein the plastic circular lid is made of a high density polyethylene, and the plastic coupler is made of a high density polyethylene.

4. The invention as recited in claim 1 wherein the tool that provides rotational torque is a power tool.

5. The invention as recited in claim 4 wherein the power tool is a drill.

6. The invention as recited in claim 1 wherein the bottom of the upper portion of the coupler includes an annular air gap inside of a peripheral, circumferential portion of the annular shoulder.

7. The invention as recited in claim 1 wherein the mixing paddle is a flat, generally open rectangular paddle having a vertical central member, two vertical side members, an upper horizontal member spanning across the top of the vertical central member between the top of the two vertical side members, a lower horizontal member spanning across the bottom of the vertical central member between the bottom of the two vertical side members, thus providing at least two openings in the paddle, and wherein the vertical height of the lower horizontal member is substantially larger than the vertical height of the upper horizontal member.

8. The invention as recited in claim 1 wherein the plastic lid further comprises an integral drive element holder that is located adjacent the circumferential rim of the lid, the holder including a bottom cradle wall having a hole therethrough, the diameter of the hole being larger than the diameter of the rod of the drive element and less than the diameter of the socket portion on the drive element, and the distance from the bottom cradle wall to a top surface of the plastic lid is greater than or equal to the vertical height of the socket portion of the drive element.

9. The invention as recited in claim 8 wherein the drive element holder further comprises three sidewalls extending upward from the bottom cradle wall to form a rectangular cube having an open top, and at least one slanted corner surface extending across the intersection of the sidewalls within the cube.

10. The invention as recited in claim 1 wherein the plastic lid has a bottom surface and the plastic lid further comprises a plurality of ribs extending radially from the bore outward along the bottom surface.

11. The invention as recited in claim 1 wherein the circumferential rim has an inward flare to facilitate a secure fit of the plastic lid on the open top of the paint can.

12. The invention as recited in claim 1 wherein the socket portion on the drive element has at least one concave surface to facilitate secure engagement of the socket portion of the drive element in the socket on the top side of the coupler.

13. A paint mixing system comprising:

a circular lid forming a cover for a paint can, the lid having a circumferential rim for attaching the lid to an open top of the paint can and a substantially vertical bore through a center portion of the lid;

a coupler secured for rotation within the lid bore, the coupler having a top side containing a socket that is exposed above the circular lid, and a paddle attachment section that extends downward below the bore in the lid;

a mixing paddle attached to the paddle attachment section of the coupler;

a drive element having a rod and a socket portion that corresponds to the socket on the top side of the coupler, wherein the socket portion of the drive element can removably engage the socket on the top side of the coupler, and the paddle can be rotated to mix paint by engaging the rod of the drive element with a tool that provides rotational torque; and a drive element holder peripheral to and adjacent the circumferential rim of the lid, the drive element holder including a bottom wall having a hole therethrough, the hole in the bottom wall having a diameter greater than the diameter of the rod on the drive element and less than the diameter on the socket portion of the drive element, and the vertical distance between the bottom wall of the drive element holder and the top surface of the lid is greater than or equal to the vertical distance of the socket portion on the drive element.

14. The invention as recited in claim 13 wherein the drive element holder further comprises three sidewalls extending upward from the bottom wall to form a rectangular cube having an open top, and at least one slanted corner surface extending across the intersection of the sidewalls within the cube, wherein the slanted corner surface is adapted to provide frictional engagement force against the socket portion of the drive element to secure the drive element in the drive element holder with the rod of the drive element being placed through the hole in the bottom wall of the holder.

* * * * *